United States Patent [19]

Hartwig et al.

[11] Patent Number: 4,610,734

[45] Date of Patent: Sep. 9, 1986

[54] PROCESS FOR MANUFACTURING CORROSION RESISTANT CHROMIUM STEEL

[75] Inventors: Jürgen Hartwig; Paul Pant, both of Essen, Fed. Rep. of Germany

[73] Assignee: Fried. Krupp Gesellschaft mit beschränkter Haftung, Essen, Fed. Rep. of Germany

[21] Appl. No.: 706,945

[22] Filed: Mar. 1, 1985

Related U.S. Application Data

[62] Division of Ser. No. 587,210, Mar. 7, 1984.

[30] Foreign Application Priority Data

Mar. 24, 1983 [DE] Fed. Rep. of Germany ..... 3310693

[51] Int. Cl.[4] ..... H01F 1/00

[52] U.S. Cl. ..... 148/120; 148/121; 148/12 E; 148/12 EA; 148/135; 148/2

[58] Field of Search ..... 148/12 E, 12 EA, 16.6, 148/120, 121, 122, 135, 2

[56] References Cited

U.S. PATENT DOCUMENTS

| | | | |
|---|---|---|---|
| 3,836,406 | 9/1974 | Yoda | 148/121 |
| 3,943,010 | 3/1976 | Hartline | 148/16.6 |
| 4,047,981 | 9/1977 | Arnold et al. | 148/16.6 |

*Primary Examiner*—John P. Sheehan

*Attorney, Agent, or Firm*—Spencer & Frank

[57] ABSTRACT

The corrosion resistant chromium steel which includes 3 to 45% chromium, 0.2 to 5% nitrogen and other elements. Its structure contains at least 50% ferromagnetic structure components. It is directly magnetizable and, at 400° C., has a yield strength of $R_{p0.2}>400$ N/mm$^2$ and, at 600° C., a yield strength of $R_{p0.2}>250$ N/mm$^2$. To produce this chromium steel, a prealloy containing at least 50% ferromagnetic structure components is nitrogen enriched under pressure, is then hot worked, then annealed at 800° to 1250° C. and finally cooled to room temperature. A tempering treatment at 450° to 750° C. may follow.

7 Claims, No Drawings

PROCESS FOR MANUFACTURING CORROSION RESISTANT CHROMIUM STEEL

CROSS REFERENCE TO RELATED APPLICATION

This application is a division of co-pending application Ser. No. 587,210 filed Mar. 7, 1984.

BACKGROUND OF THE INVENTION

The present invention relates to a process for the manufacture of a corrosion resistant chromium steel.

Austrian Pat. No. 277,301 discloses a nitrogen containing steel which has a high yield strength and good toughness characteristics. It contains up to 0.6% carbon, 5 to 40% chromium, up to 30% manganese, up to 5% molybdenum, up to 20% nickel, 1.5 to 5% nitrogen, the remainder iron, and has an austenitic structure. The nitrogen content is introduced into the steel by initially adding nitrogen containing iron-chromium or iron-manganese alloys to the melt, then introducing gaseous nitrogen into the melt or into the slag. The teaching of Austrian Pat. No. 277,301 is based on the long held understanding that in austenitic chromium-nickel and chromium-manganese alloys, nitrogen increases the austenite stability, and that in semiferritic and ferritic chromium steels containing more than 18% chromium, the presence of nitrogen results in the formation of austenite and in an increase in the proportion of transformable structures. With respect to austenite stability, 0.1% nitrogen may replace 2% nickel (see E. Houdremont, *Handbuch der Sonderstahlkunde* [Handbook of Special Steels], 1956, pages 1327–1331).

However, the production of a heat-resistant, corrosion-resistant, nitrogen containing chromium steel having a primarily ferromagnetic structure from a chromium steel having a predominantly ferromagnetic structure has never before been achieved. It would have been of interest to the industry, however, because chromium steels having ferromagnetic structures have good high temperature characteristics. For example, corrosion resistant chromium steels, containing 12 to 18% chromium, 0.5 to 1% manganese, 0.05 to 1.2% carbon, 0 to 1% silicon, 0 to 2.5% nickel, 0 to 1.3% molybdenum, 0 to 2% vanadium, 0 to 0.3% aluminum, the remainder iron, exhibit the following material characteristics after annealing or age hardening:

yield strength $R_{p0.2}=250$ to 600 N/mm$^2$
tensile strength $R_m=450$ to 950 N/mm$^2$
elongation at rupture $A_5=20$ to 12%
contraction $Z=60$ to 40%

The ferromagnetic structures of these corrosion resistant chromium steels, in the annealed state, consist of ferrite or of both ferrite and perlite and, in the age hardened state, consists of both ferrite and transformation phases, of transformation phases, or of martensite.

Compared to the austenitic chromium-nickel steels, chromium steels having a ferromagnetic structure are distinguished by having superior strength characteristics and by having very good resistance to stress crack corrosion. Even at temperatures of up to 400° C., the strength characteristics of ferritic chromium steels having a ferromagnetic structure lie far above the values for austenitic chromium nickel steels, while their characteristic deformation values lie noticeably below the values for austenitic steels. However, beginning at about 450° C. the high temperature stability of ferritic chromium steel drops considerably because of embrittlement which begins in this temperature range. Use of such steels for continuous operation is therefore limited to temperatures below 300° C. (see *Werkstoff kunde der gebräuchlichen Stähle* [Materials of Commonly Used Steels], Part 2, published by Verlag Stahleisen mbH, Düsseldorf, 1977, page 165).

SUMMARY OF THE INVENTION

It is the object of the present invention to provide a process for the manufacture of a corrosion resistant chromium steel which, even at temperatures above 400° C., exhibits the favorable characteristics of chromium steels having ferromagnetic structures without suffering embrittlement.

The process according to the present invention produces steel including 3 to 45% chromium; 0 to 10% manganese; 0.001 to 0.5% carbon; 0.2 to 5% nitrogen; 0 to 2% silicon; 0 to 10% nickel; 0 to 10% molybdenum; 0 to 5% vanadium; 0 to 2% titanium; niobium and/or tantalum; 0 to 0.3% aluminum, 0 to 1% cerium; the remainder being iron, which consists of at least 50% ferromagnetic structures, which can be magnetized, and which at 400° C. has a yield strength of $R_{p0.2}>400$ N/mm$^2$, and at 600° C. a yield strength of $R_{p0.2}>250$ N/mm$^2$. The ferromagnetic structures include ferrite, perlite, martensite and transformation structures.

It could not have been foreseen that a corrosion resistant chromium steel with predominantly ferromagnetic structural components would exhibit good high temperature stability above 400° C. We discovered, however, that the corrosion resistant steel according to the present invention showed good high temperature stability, even above 400° C., without the formation of brittle phases. This results in the advantage that components manufactured from the steel of the present invention can be made to smaller dimensions due to the favorable relationship between its corrosion behavior and high temperature stability. Thus components made from this steel can be used not only in steam turbines but also in the construction of gas turbines. Corrosion resistant ferritic chromium steels are very frequently used in this field e.g. because of their low heat dilatation values. The favourable characteristics of the claimed new ferritic steels make it possible to use this type of steels at higher temperatures than before.

The object of the invention is realized by the creation of a process for manufacturing the corrosion resistance chromium steel wherein a prealloy is employed which includes 3 to 45% chromium; 0 to 10% manganese; 0.001 to 0.5% carbon; 0 to 2% silicon; 0 to 10% nickel; 0 to 10% molybdenum; 0 to 5% vanadium; 0 to 2% titanium, niobium and/or tantalum; 0 to 0.3% aluminum; 0 to 1% cerium; the remainder being iron, and is made up of at least 50% ferromagnetic structural components. Under pressure, the prealloy is enriched in nitrogen to attain a nitrogen content of between 0.2 and 5%, which must be at least 10% greater than the nitrogen solubility limit of the prealloy at 1 bar and 20° C. The nitrogen enriched alloy is hot worked, then annealed at a temperature in the range from 800° to 1250° C., and cooled to room temperature. The nitrogen enrichment of the prealloy takes place under pressure and may be accomplished, in particular, by electric slag remelting. The nitrogen enrichment takes place under nitrogen—or argon—or helium atmospheres or under a mixture of these gases. The nitrogen enrichment is achieved by a continuous adding of metallic or semimetallic nitrogen carriers. Annealing may take place over a period of time, for example, for 0.5 to 10 hours.

In the process according to the present invention, a corrosion resistant chromium steel is produced which is primarily composed of ferromagnetic phase structures, and which can be used at temperatures above 400° C. because it contains no embrittled phases.

As a further feature of the present invention, it is provided that the steel, after being cooled to room temperature is subjected to a tempering treatment at temperatures between 450° C. and 750° C. and is then further cooled to room temperature. The duration of the tempering treatment is, for example, from 1 to 10 hours. Tempering causes further improvements in the strength characteristics, particularly in the characteristic deformation values.

The present invention will now be explained in greater detail with the aid of the following examples.

EXAMPLE I

The ferritic chromium steel 1.4002, which includes 0.06% carbon, 0.5% silicon, 1% manganese, 13% chromium, 0.01% nitrogen, 0.1% aluminum, the remainder being iron, has a ferromagnetic structure.

A. After annealing at 800° C., it exhibited the following mechanical characteristics:
yield strength $R_{p0.2}=250$ N/mm$^2$
tensile strength $R_m=600$ N/mm$^2$
elongation at rupture $A_5=20\%$.
The structure of the chromium steel consisted of ferrite. At a test temperature of 400° C., the yield strength of the steel ws about 200 N/mm$^2$.

B. After annealing at 950° to 1000° C. and cooling in oil or air, and after tempering at 600° to 750° C. and cooling in air, the same steel had the following characteristic mechanical values:
yield strength $R_{p0.2}=400$ N/mm$^2$
tensile strength $R_m=700$ N/mm$^2$
elongation at rupture $A_5=18\%$.
At a test temperature of 400° C., this steel had a yield strength of $R_{p0.2}=280$ N/mm$^2$. The structure of the steel consisted of ferrite and transformation phases.

EXAMPLE II

A nitrogen content of 0.51% was produced under pressure by electric slag remelting in a prealloy having a composition which corresponded to the composition of material 1.4002. The nitrogen enrichment took place under argon atmosphere under a pressure of 36 bar. The nitrogen enrichment was achieved by continuous adding of semimetallic nitrogen carriers. The chemical composition after nitrogen enrichment was: 0.05% C; 1% Si; 1% Mn; 13% Cr, 0.51% N; 0.1% Al; remainder Fe.

The nitrogen enriched alloy was hot worked by forging at 1180° C. and then subjected to the various heat treatments disclosed in Table 1. Table 1 shows that by slightly changing the heat treatment, three distinctly different strength levels can be set. This was particularly evident at room temperature. It was further found that at a test temperature of more than 400° C. no sudden drop occurred in the high temperature strength characteristics. Table 1 is a compilation of the results of these examinations.

The materials characterized in Table 1 exhibited an extremely fine-grained structure. Annealing at temperatures above 800° C., with subsequent cooling in air without tempering (see Table 1, horizontal column 3), resulted in the formation of a nitrogen induced martensitic structure which, when compared with cation induced martensile structure, has greater ductility with distinctly higher strength characteristics . Corrosion resistant chromium alloys with a similar chemical composition as the alloy of Example II, but with carbon contents up to 0.6% and without nitrogen (structure: perlite and carbon induced martensite), have tensile strengths not exceeding 1000 N/mm$^2$ and elongations at rupture below 10% (not guaranteed). Tempering treatment following the annealing (see Table 1, horizontal columns 1 and 2) again produced a reformation into a ferritic structure with the simultaneous formation of the finest precipitates, primarily chromium nitride. The high temperature stability of the nitrogen enriched steels at 400° C. was far above the values for known stainless ferritic chromium steels having ferromagnetic structures (e.g. Example I) and did not break down above this temperature. This is presumably the result of the restricted atomic mobility in the lattices typical of highly alloyed steels when temperatures are increased.

EXAMPLE III

The composition of material 1.4002 was altered by the addition of nickel and molybdenum to concentrations of 2.9% and 3.5%, respectively, and by reducing the carbon content to 0.03%. The structure of this starting alloy consists of 90% ferrite, remainder martensite.

In this primarily ferritic prealloy, a nitrogen content of 0.51% was introduced by electric slag remelting under pressure.

The nitrogen enrichment took place under argon atmosphere at a pressure of 36 bar. The nitrogen enrichment was achieved by a continuous adding of semimetallic nitrogen carriers. The chemical composition after nitrogen enrichment was: 0.025% C; 0.51% N; 1.5% Mn; 1.5% Si; 2.9% Ni; 3.5% Mo; 0.1% Al; remainder Fe.

The nitrogen enriched alloy was hot worked by forging at 1180° C. and then subjected to various heat treatments. The characteristics of the materials thus produced are compiled in Table 2. Table 2 shows that the materials characterized therein have strength characteristics which lie far above those of conventional corrosion resistant chromium steels. The different heat treatments produced, inter alia, a change in the ratio of $R_{p0.2}$:$R_m$. If the homogenization annealing process is performed below 1000° C., this ratio is approximately 0.7. For annealing above 1000° C., the ratio had a value of about 0.5. At the higher test temperatures, the strength level of the steels according to the present invention characterized in Table 2 were far above the strength level of the austenitic chromium-nickel steels. Metallographic examination showed that the materials characterized in Table 2 were composed primarily of ferrite, transformation phase structures and chromium nitride of precipitates.

The possibility of using the materials characterized in Tables 1 and 2 at temperatures above 400° C. was confirmed by the examination of their long-term stability at 400° to 750° C. over a period of time of more than 100 hours. So far example creep tests achieved on samples of the alloy characterized in table 2 (example III) resulted in the following values: (a) creep strength with 1% elongation in 10,000 h at 500° C.: 200 N/mm$^2$ (b) creep strength with 1% elongation in 10,000 h at 600° C.: 130 N/mm$^2$.

All percentages herein referring to the composition of materials and alloys are weight percentages. The percentages referring to the individual structural components are volume percentages. The structural components may be determined by electron microscopy or by X-ray diffraction. The term room temperature is understood to mean a temperature of about 20° C.

It will be understood that the above description of the present invention is susceptible to various modifications, changes and adaptations, and the same are intended to be comprehended within the meaning and range of equivalents of the appended claims.

TABLE 1

| Heat Treatment (annealing condition tempering conditions) | RT $R_{p0.2}$ N/mm² | RT $R_m$ N/mm² | RT $A_5$ % | RT Z % | 400° C. $R_{p0.2}$ N/mm² | 400° C. $R_m$ N/mm² | 400° C. $A_5$ % | 400° C. Z % | 600° C. $R_{p0.2}$ N/mm² | 600° C. $R_m$ N/mm² | 600° C. $A_5$ % | 600° C. Z % |
|---|---|---|---|---|---|---|---|---|---|---|---|---|
| 0.5 h 950° C./air + 3 h 650° C./air | 600 | 820 | 22 | 70 | 500 | 640 | 20 | 70 | 380 | 550 | 18 | 65 |
| 0.5 h 1050° C./air + 3 h 600° C./air | 830 | 1060 | 17 | 56 | 720 | 870 | 15 | 60 | 630 | 750 | 14 | 42 |
| 0.5 h 900° C./air (no tempering) | 1160 | 1450 | 13 | 44 | | | | | | | | |

TABLE 2

| Heat Treatment | RT $R_{p0.2}$ N/mm² | RT $R_m$ N/mm² | RT $A_5$ % | RT Z % | 400° C. $R_{p0.2}$ N/mm² | 400° C. $R_m$ N/mm² | 400° C. $A_5$ % | 400° C. Z % | 600° C. $R_{p0.2}$ N/mm² | 600° C. $R_m$ N/mm² | 600° C. $A_5$ % | 600° C. Z % |
|---|---|---|---|---|---|---|---|---|---|---|---|---|
| 0.5 h 950° C./air + 3 h 650° C./air | 950 | 1360 | 14 | 27 | 800 | 1200 | 10 | 20 | 550 | 800 | 15 | 30 |
| 0.5 h 1050° C./air + 3 h 600° C./air | 600 | 1200 | 17 | 40 | 360 | 740 | 37 | 58 | 320 | 630 | 33 | 62 |
| 0.5 h 1050° C./air + 3 h 650° C./air | 650 | 1300 | 15 | 35 | 440 | 800 | 27 | 44 | 400 | 650 | 27 | 60 |

What is claimed is:

1. A process for producing a corrosion resistant chromium steel which comprises 3 to 45% chromium; 0 to 10% manganese; 0.001 to 0.5% carbon; 0.2 to 5% nitrogen; 0 to 2% silicon; 0 to 10% nickel; 0 to 10 % molybdenum; 0 to 5% vanadium; 0 to 2% titanium, niobium and/or tantalum; 0 to 0.3% aluminum; 0 to 1% cerium; the remainder being iron; and having a structure containing at least 50% ferromagnetic structural components, is magnetizable and, at 400° C., has a yield strength of $R_{p0.2}>400$ N/mm² and, at 600° C., has a yield strength of $R_{p0.2}>250$ N/mm², the process comprising the steps of (a) introducing nitrogen by electric slag remelting into a prealloy comprising 3 to 45% chromium; 0 to 10% manganese; 0.001 to 0.5% carbon; 0 to 2% silicon; 0 to 10% nickel; 0 to 10% molybdenum; 0 to 5% vanadium; 0 to 2% titanium, niobium and/or tantalum; 0 to 0.3% aluminum; 0–1% cerium, the remainder being iron; and having a structure containing at least 50% ferromagnetic structural components; until a nitrogen content of between 0.2 and 5% is reached in the prealloy; wherein nitrogen enrichment by electric slag remelting takes place under greater than atmospheric pressure, at least part of the nitrogen introduced is in the form of solid nitrogen carriers, and the nitrogen content of the nitrogen enriched alloy is at least 10% greater than the nitrogen solubility limit of the alloy at 1 bar and 20° C.; (b) hot working the nitrogen enriched alloy; (c) annealing at 800° to 1250° C.; and (d) then cooling to room temperature.

2. The process of claim 1, wherein, after annealing, the alloy is cooled to room temperature, tempered at temperatures between 450° C. and 750° C., and is then cooled to room temperature.

3. The process of claim 1, wherein annealing takes place for a period of from 0.5 to 10 hours.

4. The process of claim 1, wherein the nitrogen enrichment by electric slag remelting takes place under an atmosphere of at least one gas selected from the group consisting of nirogen, argon and helium.

5. The process of claim 4, wherein the gas is selected from argon, helium, and a mixture of argon and helium.

6. The process of claim 4, wherein the nitrogen is introduced during electric slag remelting by continuously adding metallic or semi-metallic nitrogen carriers.

7. The process of claim 1, wherein all nitrogen is introduced into the prealloy in the form of solid nitrogen carriers.

* * * * *